United States Patent [19]

Emrich et al.

[11] 4,317,300

[45] Mar. 2, 1982

[54] EARTH WORKING TOOTH WITH WEAR CAP

[75] Inventors: Robert K. Emrich; William H. Prather; John M. Burkhart, all of Portland, Oreg.

[73] Assignee: ESCO Corporation, Portland, Oreg.

[21] Appl. No.: 220,283

[22] Filed: Dec. 29, 1980

Related U.S. Application Data

[63] Continuation-in-part of Ser. No. 77,297, Sep. 20, 1979, abandoned.

[51] Int. Cl.[3] ..... E02F 9/28

[52] U.S. Cl. ..... 37/142 R

[58] Field of Search ..... 37/141 R, 141 T, 142 R, 37/142 A; 172/772, 719

[56] References Cited

U.S. PATENT DOCUMENTS

| | | | |
|---|---|---|---|
| 1,776,676 | 9/1930 | Bauer | 37/142 R |
| 1,918,841 | 7/1933 | Finkl | 37/142 R |
| 2,284,178 | 5/1942 | Sublett | 37/142 R |
| 2,762,139 | 9/1956 | Launder | 37/142 A |
| 2,896,345 | 7/1959 | Peklay | 37/142 R |
| 2,968,880 | 1/1961 | Petersen | 37/142 A |
| 2,987,838 | 6/1961 | Stratton | 37/142 A |
| 3,020,655 | 2/1962 | Launder | 37/142 A |
| 3,082,555 | 3/1963 | Hill | 37/142 R |

FOREIGN PATENT DOCUMENTS

| | | | |
|---|---|---|---|
| 272690 | 4/1965 | Australia | 37/142 A |

*Primary Examiner*—Clifford D. Crowder

*Attorney, Agent, or Firm*—Tilton, Fallon, Lungmus & Chestnut

[57] ABSTRACT

An earth working tooth with wear cap wherein the wear cap has a closed forward end with horizontally extending side wings to mate with longitudinal side grooves of the adapter, the forward end being equipped with forwardly extending side projections to defer wear which would jeopardize the wings and grooves and simultaneously promote build-up of earth to protect the releasable lock between the tooth point and adapter.

16 Claims, 11 Drawing Figures

FIG. 1
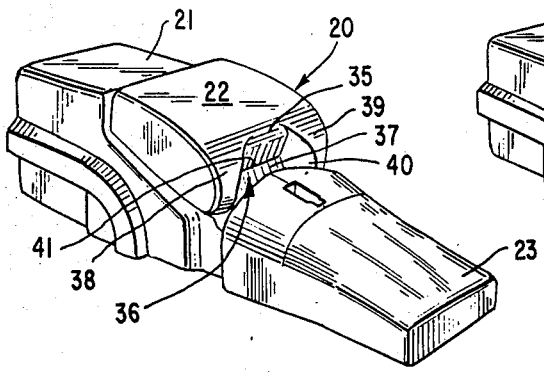
FIG. 2
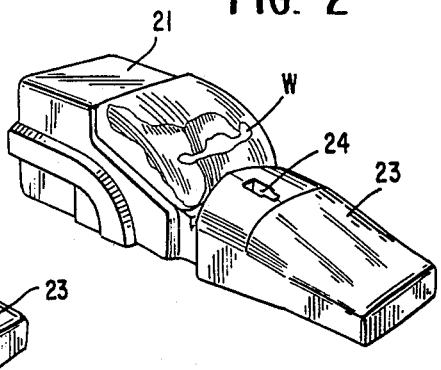
FIG. 3
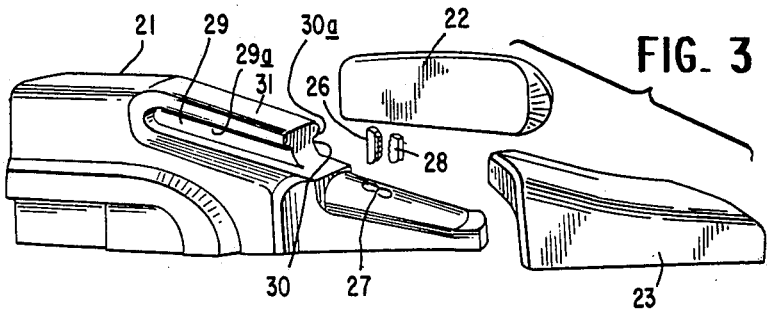
FIG. 4
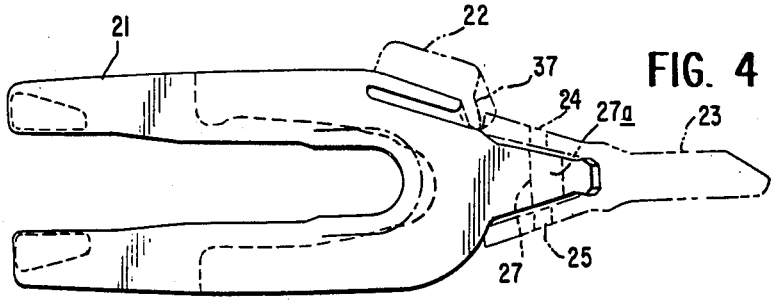
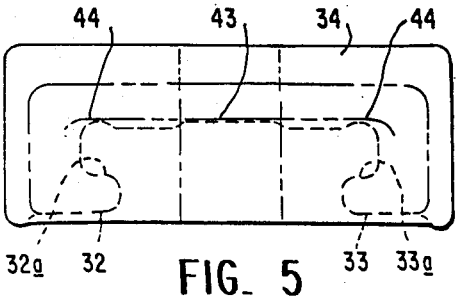
FIG. 5
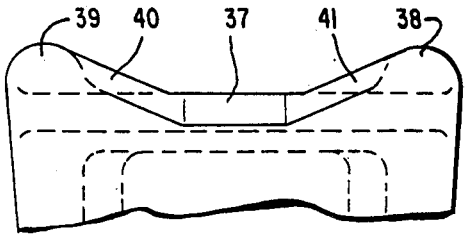
FIG. 4A FIG. 6
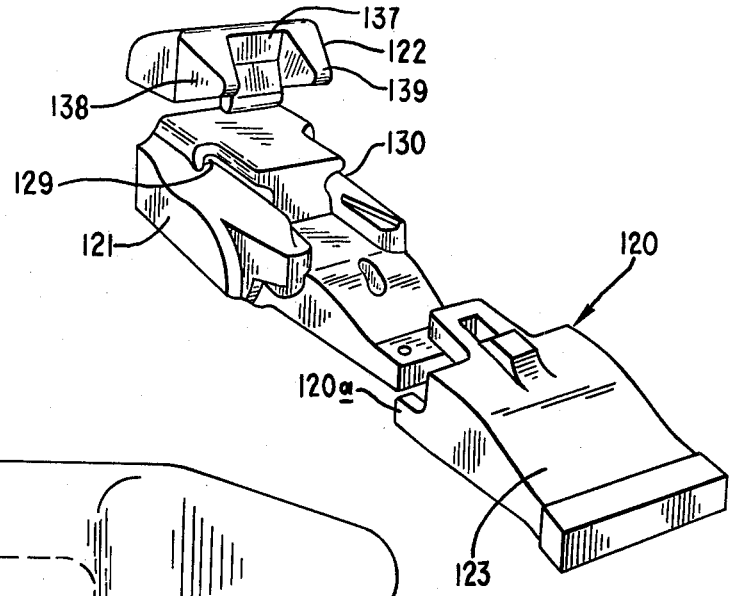
FIG. 7
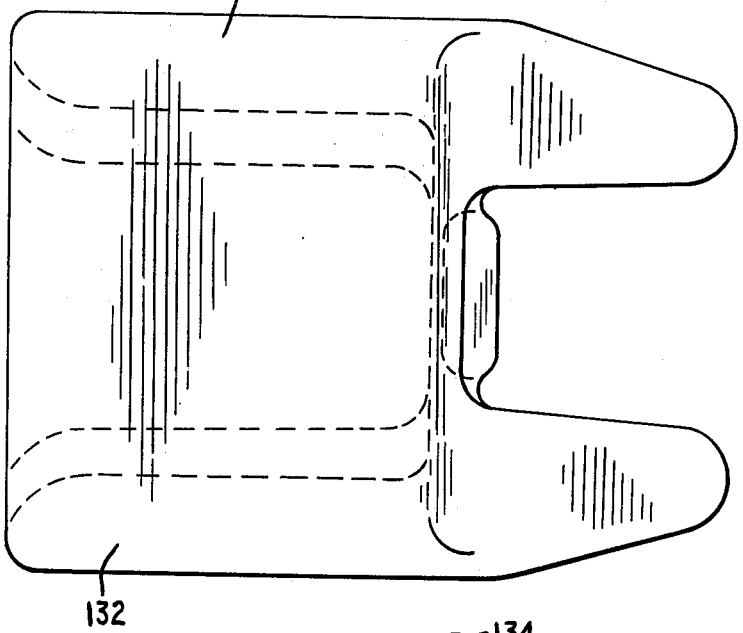
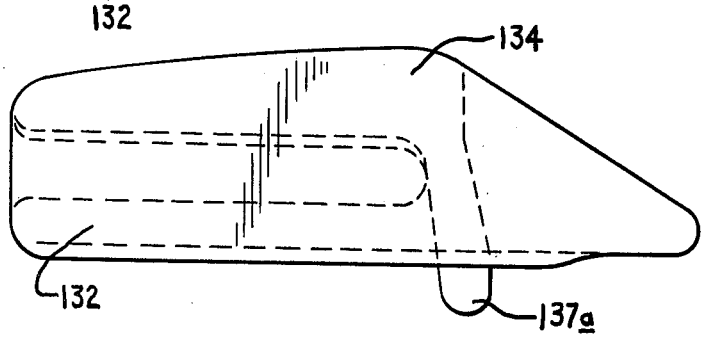
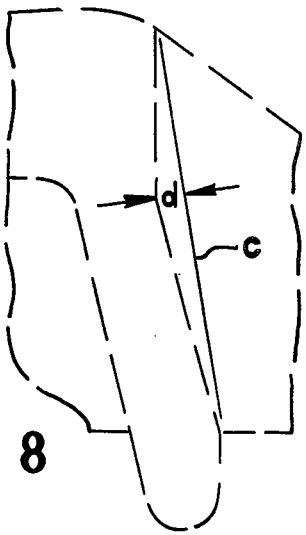
FIG. 8
FIG. 8a
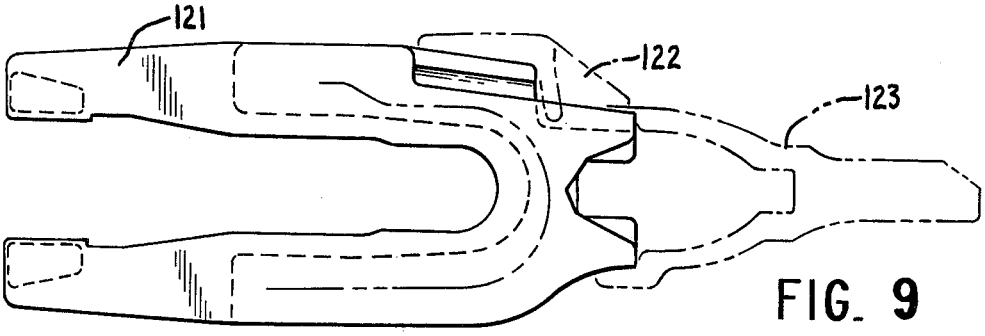
FIG. 9

EARTH WORKING TOOTH WITH WEAR CAP

This application is a continuation-in-part of our copending application Ser. No. 77,297, filed Sept. 20, 1979, now abandoned.

BACKGROUND AND SUMMARY OF INVENTION

This invention relates to an earth working tooth with wear cap and, more particularly, to a uniquely contoured and constructed wear cap that promotes longer life of the tooth. The tooth with which the instant invention is concerned includes an adapter which is designed to be fastened so as to project forwardly from the leading edge of earth working equipment, i.e., buckets, dippers, etc. At the projecting forward end of the adapter, a nose is normally provided which is received within the socket of the replaceable point, the two being fastened together by means of a removable lock. Normally, 5 to 10 replaceable points are used during the life span of the adapter.

Starting about 25 years ago, efforts were made to extend even further the life of the adapter—it being appreciated that this is a relatively heavy element and that considerable down time of valuable equipment may be required for its replacement. One such effort is seen in Peklay U.S. Pat. No. 2,896,345 wherein the wear cap was provided on the top surface of the adapter and held in place by means of the cooperation of a tongue and groove connection along the sides of the wear cap and adapter and the projection of the top wall of the point. This proved inadequate because the constant flow of material over the wear cap wore away the metal, particularly along the sides of the top of the cap. This threatened the central dovetail connection and led to the improvement set forth in Hill U.S. Pat. No. 3,082,555.

An important distinction in the Hill U.S. Pat. No. 3,082,555 was the enthickening of the cap along the sides in an attempt to prolong the wear life of the cap. This also proved unsuccessful so the Hill construction was modified to eliminate the angled bottom sides of the cap and to extend the depending tongue the full length of the cap so as to provide for reversibility—the thought being that the live could be effectively extended by reversing the cap after the dovetail connection at the forward end had become threatened. This reversible modification of the Hill '555 construction has been widely utilized for the last 15 years or so.

Even though the reversible feature provided the advantage of a somewhat extended wear life, it maintained the disadvantage of the Hill construction over the Pecklay construction in continuing to expose the connection between the cap and adapter at the cap forward end. This meant that material flowing rearwardly over the tooth had the opportunity of entering into the space between the surfaces providing the dovetail connection and creating wear which could lead to looseness and premature failure.

Furthermore, in the oft-repeated event of inadequate maintenance—as where these wear caps were not replaced soon enough, the forward end of the wear cap dovetail become partially worn away. This proved catastrophic to the service life of the adapter because it would no longer retain wear caps.

This has been avoided by the instant invention which, in a sense, is a partial return to the Pecklay '345 construction by virtue of having a closed forward end on the wear cap so as to protect the bearing surfaces constituting the connection between the cap and adapter. However, two significant differences characterize the invention over Pecklay '345. First, the bearing surfaces of the cap/adapter connection are no longer dovetailed but are "horizontal", i.e., parallel to each other on the opposite sides of the cap and, more particularly, a massive section has been added at the very front of the cap which is characterized by forwardly extending side projections. These projections effectively extend the life of the cap by installing more wear metal at the point of crucial wear, i.e., just forward of the side rail connection. Thus, it will take correspondingly longer before flowing earth which can be quite abrasive, can enter into the spaces between the bearing surfaces of the connection. Additionally, the parallel bearing surfaces provide effective retention of wear caps even where their forward end has worn when a wear cap has been allowed to wear through. Here it should be appreciated that close fits between interconnected parts are impossible not only because of the production of these parts by casting but also because the interconnected parts may have different degrees of wear.

The provision of the forward projections on the cap generated an additional benefit in the fact that the generally cup-shaped forward contour generated by these projections provided a barrier which induced buildup of material on the top of the point in the crucial central rear area about the pin lock. This is the location of incipient failure because of the removal of material for the pin lock and also because of the repetitive stresses which are localized in this area.

Although the concept of providing a barrier at the rear of the point to develop a buildup is not new—see Stratton U.S. Pat. No. 2,987,838, it has not been utilized in commercially available excavating teeth. More particularly, when Stratton attempted to provide this function through the use of a wear cap, he provided no forward projections, no closed forward end and utilized the inferior dovetail connection between the cap and adapter.

It should also be appreciated that wear caps having parallel side rails or wings to enter into grooves on the side of the adapter have also been known for a substantial period—see Patersen U.S. Pat. No. 2,968,880. However, this construction has also failed to reach commercial significance not only because of the flimsiness of the sheet metal cap but, more importantly, the fact that the cap was not closed at the front so as to protect the important connection along the sides of the cap and adapter.

DETAILED DESCRIPTION OF THE INVENTION

The invention is described in conjunction with the accompanying drawing, in which FIG. 1 is a perspective view of a fragment of the excavating tooth of the instant invention, only a portion of the adapter being shown and that portion of the tooth above the horizontal mid-plane;

FIG. 2 is a showing similar to FIG. 1 but with the wear cap in worn condition just prior to replacement;

FIG. 3 is an exploded perspective view of the showing of FIG. 1;

FIG. 4 is a side elevational view of the adapter employed in the invention along with the point and wear cap shown in dotted line;

FIG. 4A is a fragmentary top plan view of the front portion of the wear cap;

FIG. 5 is a front elevational view of the wear cap of FIGS. 1–4;

FIG. 6 is an exploded perspective view of a modified form of inventive tooth;

FIGS. 7 and 8 are, respectively, top plan and side elevational views of the wear cap of the assembly of FIG. 6;

FIG. 8A is a fragmentary side elevational view showing the vertical curvature of the wear cap forward wall with dimensional figures indicated thereon; and FIG. 9 is a side elevational view of the adapter of the assembly of FIG. 6 again with the wear cap and point shown in dotted line.

Turning to the first drawing sheet, FIG. 1 illustrates the principal parts of the earth working or excavating tooth generally designated 20. The numeral 21 designates the adapter which is of the Whisler type (see particularly FIG. 4) having a split shank so as to straddle the leading edge of a bucket or other earth receiving device. The wear cap is designated 22 and the point 23. The point is equipped with aligned openings 24 and 25 adapted to receive a pin 26 which extends through a further aligned opening 27 in the adapter and bears against a plug 28 positioned within an enlarged portion 27*a* of the adapter opening 27. The pin, plug and openings can be seen in greater detail in U.S. Pat. No. 3,126,654.

The adapter 21 adjacent the top thereof is equipped with recesses 29 and 30 opening to the adapter sides and which provide bearing surfaces therein—on the parallel upper (i.e., donwardly facing) surfaces thereof 29*a* and 30*a*. This is developed by the general T shape having an upper bar 31 providing side flanges for the imposition of stress from the inwardly facing, parallel wings 32 and 33 on the wear cap—the wear cap providing parallel upwardly facing surfaces 32*a* and 33*a* on the wings thereof (see FIG. 5). Thus, any force having an upward component on the wear cap brings the rail lock surfaces 32*a*, 33*a* into contact with the flange surfaces 29*a*, 30*a* to resist the dislodging force.

The cap 22 is characterized by a relatively massive section 34 (see FIG. 4) along its top, particularly in the front portion thereof. This massive section extends rearwardly from the central front-facing wall 35 (see FIG. 1). The front-facing wall 35, in the illustration given in FIGS. 1–5, has an inclination relative to the horizontal of at least about 75° so that the same is generally vertical. The wall 35 is flanked by forwardly extending, integral projections 38 and 39 (see FIG. 1) which, in combination with the wall 35 and the forwardly sloping wall 37, develop a cavity generally designated 36. Thus, the entire front of the cap 22 is closed to protect the confronting surfaces of the cap and adapter—see particularly FIG. 4.

As indicated previously, the projections 38 and 39 serve to place additional wear metal forward of the crucial side rails or wings 32, 33 and slots or recesses 29, 30. As can be appreciated from a consideration of FIG. 2, remnants of the projections still remain even after a substantial portion of the front massive section has been worn away—see the irregular shaped aperture W, indicating a complete wear-through of the cap in this area. This provides a visual indication that cap replacement is necessary.

As indicated above and best seen in FIG. 1, concavity 36 is defined by integral forwardly extending portions 38 and 39 which diverge in proceeding forwardly (see FIG. 4A). The portions 38, 39 are developed by walls 40, 41 that extend forwardly from the central vertical wall portion 37 at an angle of at least about 25°. As the cavity providing walls 40, 41 extend further forwardly, their angularity or cup-shaped become more pronounced, especially adjacent the upper parts of the portions 38 and 39 (see FIG. 4A). This provides a unique operation in protecting both the cap 22 and the point 23 particularly in the area of the pin lock 26.

For example, earth is forced to flow both inwardly and rearwardly by virtue of encountering the projections 38, 39. This results in an earth build-up in the cavity or cup-shape 36—the earth flow being resisted by the massive section 34. Because of their lateral tapering nature, the projections 38, 39 (see FIG. 1) offer increased protection to the side means 28, 29, 32, 33 for folding the cap on the adapter—all while still providing a flow of earth that in effect, has "dirt wearing on dirt".

The arrangement depicted in FIGS. 1–5 is particularly suited for teeth made in accordance with U.S. Pat. No. 2,919,506. For a later generation tooth (see U.S. Pat. No. 4,231,173) a slightly modified form of cap is provided but which utilizes the teachings of the invention heretofore set down—the modified form is shown on the second drawing sheet.

Reference is now made to the second sheet of the drawings wherein like numbers are employed to designate like parts, but with the addition of 100. Thus, in the exploded view of FIG. 6, the numeral 120 designates the tooth generally and which is made up of an adapter 121, a wear cap 122, and a point 123. The various elements making up the releasable lock for the point on the adapter are identical to those previously designated by the numerals 24–28 and are omitted from this embodiment for clearness of presentation.

In this embodiment, the cap 122 is mounted in precisely the same way on the adapter 121 as previously described, i.e., parallel wings 132 and 133 on the cap are installed within recesses 129 and 130 on the adapter sides. Likewise there is a massive section 134 at the top of the cap 122. The differences between this embodiment and the one previously described stem primarily from the difference in the points 23 and 123. The point 123, for example, has rearwardly extending tongues on the top, bottom and sides thereof which are normally received within corresponding recesses in the adapter 121. Further details of the point and adapter of this embodiment can be seen in the above-mentioned U.S. Pat. No. 4,231,173 and the disclosure of that patent is incorporated herein by express reference.

In this embodiment, as before, the wear cap is retained in place against forward movement by the interference or overlap with the rear end of the point. Because the point in this embodiment is equipped with the rearwardly extending tongues, a slight change in the forward or front contour of the wear cap is indicated. For example, the central vertical wall portion 137 projects downwardly between the forwardly divergent portions 138 and 139 to provide this overlap or interference and the forwardly divergent portions 138, 139 (which develop the concavity or cup-shape) are extended further forwardly so as to completely overlie the portions of the adapter which otherwise would be exposed—due to the function of accommodating the various rearwardly extending tongues 120*a* on the point. Other than in these specific structural differences, the wear caps 22, 122 function in the same way of directing and confining earth to protect the cap rail lock and point pin lock.

This is achieved by providing that portion of the central forwardly facing wall above the point at least twice as high as the vertical thickness of the wings 32, 33. For example, the overall height of one size of wear cap is 111 mm. The portion of this height above the point is 90 mm. whereas the thickness of the wings 32, 33 is about 25 mm. In this regard, the underside of the wear cap 120 is the same as that of wear cap 20 and the rear elevation for this embodiment is analagous to that seen in FIG. 5.

Through the provision of the wings and recesses, bearing surfaces are provided as indicated at 29*a*, 30*a* and 32*a*, 33*a* so that both the portion of the cap above the wing bearing surfaces and the flange portions of the adapter above the recess bearing surfaces have to be worn away before earth passing over the wear cap can engage both sets of bearing surfaces and cause dislodgment of the wear cap. Well before this occurs, the massive section at the front of the wear cap (the side wings extending only part way from the rear of the cap to develop this massive section) will have been worn away in the fashion indicated at W in FIG. 2 through the earth-directing function of the projections 38, 39 to provide a visual indication that the cap needs replacement. This is true irrespective of the forward contour of the wear cap, either that of the embodiments of FIGS. 1–5 wherein the cap has a generally box-shape in side elevation or the embodiment of FIGS. 6 to 9 wherein the central front facing wall 135 is extended below the bottom of the cap to provide a depending flange 137*a* (see particularly FIG. 8). It will also be noted that in the embodiments of FIGS. 1–9, the vertical thickness of the wings 32, 33 is the same as that of the adapter flanges above the bearing surfaces 29*a*, 30*a*.

It will be appreciated that, dependent upon the circumstances, wear caps can be used either on the top or bottom surface of the adapter, or both. For example, there is merit in employing a wear cap only on the bottom where the structure such as a shovel dipper is subject to wear particularly on its bottom surface. The arrangement is precisely as pictured wherein the parts cooperate to prevent inadvertent dislodgment of the wear cap.

It should be appreciated that where the terms "top" and "bottom" are employed, these are directed to the generally horizontally extending surfaces of the adapter or like structure when the same is in the position for penetrating material.

In both embodiments, the forwardly facing cavity (as at 36 in FIG. 1) is concave generally in the vertical plane—compare, for example, FIGS. 4 and 8. This results from angling the upper and lower portions of the central front facing wall (as at 35 in FIG. 1) and which is illustrated schematically relative to the second embodiment in FIG. 8A. It will be seen there that the concavity has a depth d which is substantially less than the chordal length c. Advantageously, the depth should be at least about 5% of the chordal length.

While in the foregoing specification, the invention has been discribed in detail, many variations may be made in those details without departing from the spirit and scope of the invent on.

We claim:

1. An earth-working tooth comprising an elongated adapter having a point-receiving part at its forward end and means at the rear end for securing said adapter to earth working equipment, a wear cap removably mounted on a generally horizontally extending surface of said adapter, and a point removably mounted on said adapter part maintaining said wear cap in place of said adapter, said wear cap having a central forwardly facing wall flanked by forwardly extending projection along the cap sides, rail lock means interconnecting said cap and adapter rearwardly aligned with said projections and including parallel recesses in the sides of said adapter adjacent to but spaced vertically of said adapter surface and providing parallel generally horizontally extending bearing surfaces, said wear cap having parallel side wings received in said recesses, said wings providing parallel bearing surfaces arranged to contact said recess bearing surfaces, and said projections diverging forwardly from said forwardly facing wall.

2. The tooth of claim 1 in which the recesses in said adapter extend rearwardly from adjacent the front thereof to provide a T configuration and providing thereby outwardly extending flanges on the bar of said T, said adapter flanges and cap wings having approximately the same vertical thickness.

3. An earth-working tooth comprising an elongated adapter having a point-receiving part at its forward end and means at the rear end for securing said adapter to earth-working equipment, a wear cap removably mounted on the top of said adapter, and a point removably mounted on said adapter part and maintaining said wear cap in place on said adapter, said wear cap having a central forward-facing wall flanked by forwardly extending projections along the cap sides, rail lock means interconnecting said cap and adapter rearwardly aligned with said projections and including parallel recesses in the sides of said adapter adjacent to but below the adapter top and providing parallel donwardly facing bearing surfaces, said wear cap having parallel side wings received in said recesses, said wings providing upwardly facing parallel bearing surfaces arranged to contact said recess bearing surfaces, and projections diverging forwardly from said central forwardly facing wall thereby directing earth toward said central forwardly-facing wall for earth build up to protect the point upper surface while also providing wear metal forwardly of said rail lock means to protect the same.

4. The tooth of claim 3 in which said wear cap projections are forwardly laterally tapered to provide additional protection for said rail lock means while promoting laterally inward rearward flow of earth.

5. The tooth of claim 3 in which said point has a pin lock spaced forwardly of said cap central forwardly-facing wall.

6. The tooth of claim 3 in which said side wings extend only partway from the rear of said cap to provide a massive front wall section.

7. The tooth of claim 3 in which the portion of said central forwardly-facing wall above said point extends at least twice as high as the vertical thickness of said wings.

8. The tooth of claim 3 in which said central front-facing wall terminates in the bottom wall of said cap to give said cap a generally box-shape in side elevation.

9. The tooth of claim 3 in which said central front-facing wall is extended below the bottom wall of said cap to provide a depending flange.

10. The tooth of claim 9 in which said front facing wall has a generally flat central portion extending substantially vertically, said forwardly extending projections overlying portions of said adapter.

11. The tooth of claim 3 in which said wear cap central forwardly-facing wall has a central generally flat portion extending substantially vertically and said forwardly extending projections meet said wall at an angle of at least about 25°.

12. A wear cap for an earth working tooth comprising a unitary metal member having a central front facing wall flanked by divergent forwardly extending side projections to provide a concavity facilitating build-up on said tooth of earth being worked, said wear cap having sidewalls extending rearwardly from said projections, and inwardly extending wings along the bottom edges of said sidewalls for mounting said wear cap on said tooth.

13. The structure of claim 12 in which said wall is arranged and constructed to provide a vertically contoured concavity.

14. The structure of claim 13 in which said concavity has a depth to chord ratio of at least about 5%.

15. The structure of claim 12 in which said forwardly divergent projections intersect said wall at an angle of at least about 25°.

16. An earth-working tooth having an elongated adapter having a point-receiving part at its forward end and means at the rear end for securing said adapter to earth-working equipment, a wear cap removably mounted on the top of said adapter, and a point removably mounted on said adapter part and maintaining said wear cap in place on said adapter, said point being equipped with pin lock means centrally forward of said wear cap, the improvement characterized by said adapter having parallel recesses in the sides thereof adjacent to but below the adapter top and providing downwardly-facing bearing surfaces, said wear cap having parallel side wings received in said recesses constituting rail lock means for mounting said wear cap on said adapter, said wings providing upwardly facing bearing surfaces arranged to contact said recess bearing surfaces, said wear cap being equipped with laterally forwardly divergent integral projections extending forwardly from said rail lock means and providing therebetween a central forwardly-facing generally vertical wall to facilitate earth build up over said point pin lock means.

* * * * *